United States Patent [19]

Crosier

[11] 4,253,720

[45] Mar. 3, 1981

[54] FRONT TAP SHOE

[75] Inventor: Claire G. Crosier, San Marcos, Calif.

[73] Assignee: Communications Technology Corporation, Los Angeles, Calif.

[21] Appl. No.: 73,931

[22] Filed: Sep. 10, 1979

[51] Int. Cl.[3] ..... H01R 13/62

[52] U.S. Cl. ..... 339/75 M; 339/91 R

[58] Field of Search ..... 339/75 R, 75 M, 75 P, 339/91 R, 92 R, 92 M; 292/260, 256.71, 25, 96

[56] References Cited

U.S. PATENT DOCUMENTS

| | | | |
|---|---|---|---|
| 422,739 | 3/1890 | Darmstadt | 292/25 |
| 3,135,438 | 6/1964 | Wex et al. | 292/256.71 |
| 3,569,910 | 3/1971 | Poe | 339/91 R |
| 3,575,482 | 4/1971 | McMaster et al. | 339/91 R |
| 3,830,525 | 8/1974 | Ransford | 339/75 R |
| 4,128,739 | 12/1978 | Bernstein | 339/255 R |

*Primary Examiner*—John McQuade

[57] ABSTRACT

A tap shoe for making electrical connections between a plurality of conductors in a cable and a plurality of conductors in a terminal block, typically used for making interconnections in telephone plant facilities. A body with top, bottom, opposing sides and opposing ends, with a plurality of electrical terminals in the body and accessible at the bottom and with means for connecting a cable to the terminals and feeding the cable from the body, typically through the top. A bar carried along the top with depending arms at each end riding in slots in the body, with the arms having a pin or other arrangement for engaging a J slot or other arrangement in the equipment frame, and a screw or screws for moving the bar away from the body locking the shoe in place on the equipment frame.

3 Claims, 4 Drawing Figures

FRONT TAP SHOE

BACKGROUND OF THE INVENTION

This invention relates to a device for making a plurality of electrical connections between an electrical cable and an electrical terminal block and in the telephone industry, such devices are typically referred to as tap shoes. One such tap shoe and its use is illustrated in the U.S. Pat. No. 4,128,739, issued Dec. 5, 1978. In this prior art device, after the shoe is engaged with the terminal block making the plurality of electrical connections, a plate is pivoted at each end of the shoe for interengaging the terminal block or frame which carries the terminal block to lock the shoe in position. This type of shoe installation and locking is not suitable for all situations and it is an object of the present invention to provide a new and improved tap shoe having a locking configuration which eliminates pivoting and projecting plates and the like.

Other objects, advantages, features and results will more fully appear in the course of the following description.

SUMMARY OF THE INVENTION

The tap shoe of the present invention includes a body with top, bottom, opposing sides and opposing ends, means defining a slot at each of the ends along a path between the top and bottom, and a plurality of electrical terminals carried within the body and accesible at the bottom. The tap shoe further includes a bar carried along the top of the body with arms at each end of the body carried on the bar and sliding in the slots at the ends of the body. Each arm carries means for interengaging with the terminal block, typically projecting pins which ride in J slots in the block. A thumb screw or similar arrangement is provided for moving the bar away from the body to lock the shoe in position on the terminal block.

DESCRIPTION OF THE PREFERRED EMBODIMENT

Figure 1:
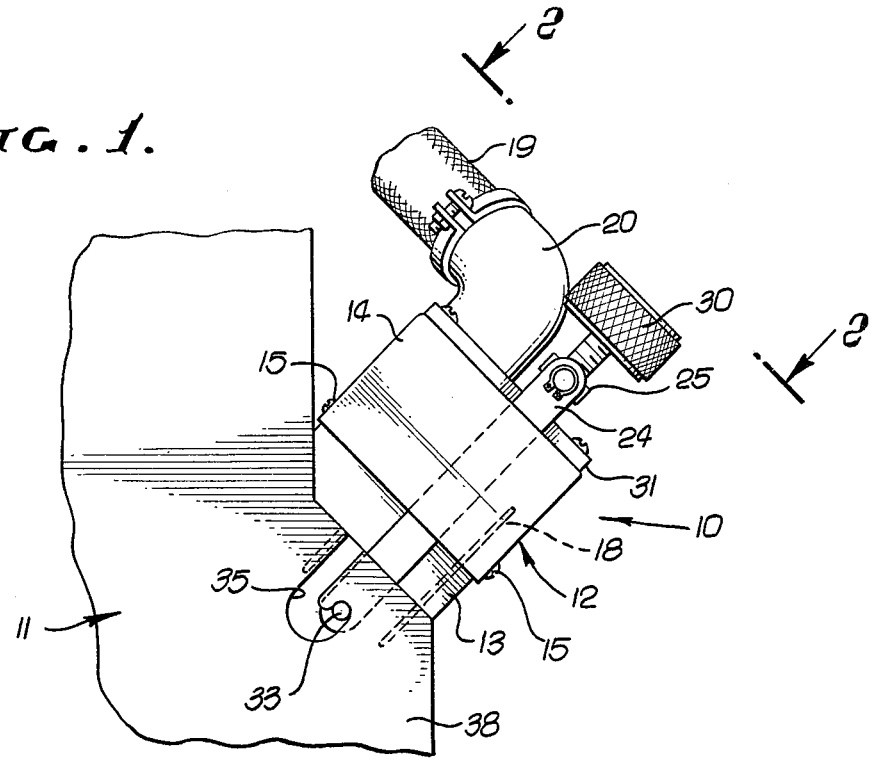
FIG. 1 is a side view of a tap shoe in position on a terminal block and incorporating the presently preferred embodiment of the invention.
Figure 2:
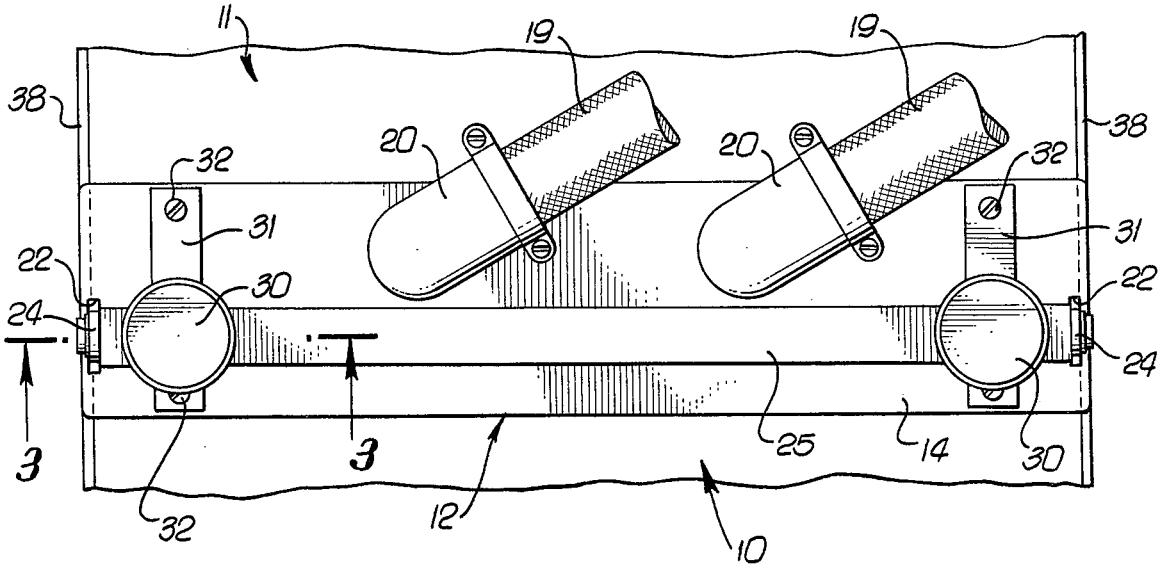
FIG. 2 is a top view of the tap shoe taken along the line 2—2 of FIG. 1.
Figure 3:
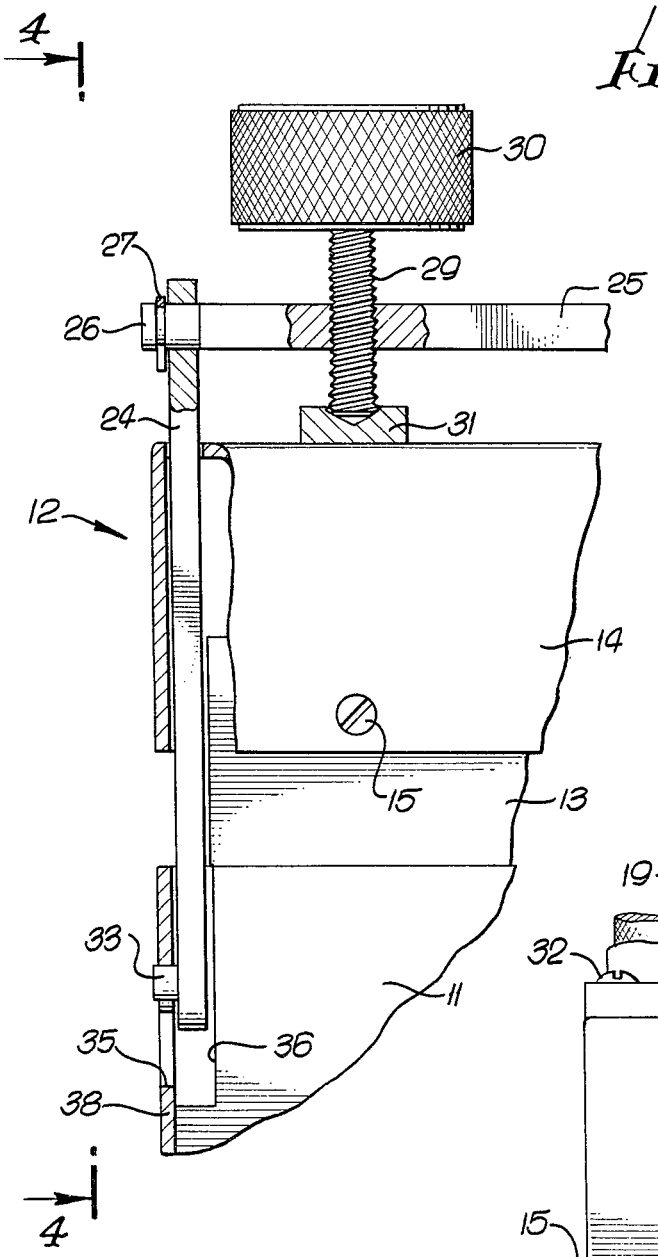
FIG. 3 is an enlarged partial sectional view taken along the line 3—3 of FIG. 2.
Figure 4:
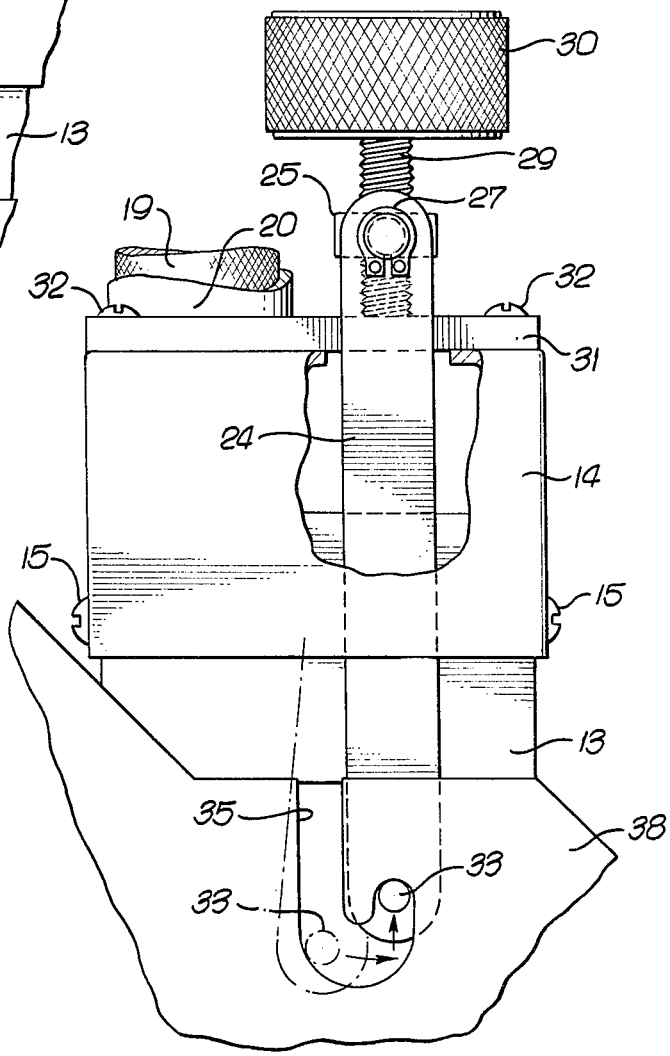
FIG. 4 is a view taken along the line 4—4 of FIG. 3.

In the figures of the drawings, a tap shoe 10 is shown mounted on a terminal block 11. The tap shoe has a body 12 comprising a terminal block 13 and a cover 14 attached to the terminal block by screws 15. A plurality of electrical terminals, indicated generally at 18 are carried in the block 13. These terminals may be of any conventional construction and typically project outwardly from the bottom of the body for engaging mating terminals in the terminal block 11. One or more electrical cables 19 enter the cover 14 through conduits 20 and are connected to the terminals 18.

Slots 22 in the cover 14 define a path through the body between the cover 14 and block 13 between the top and bottom of the body. Arms 24 are positioned at each end of the body in the respective slots 22. Each arm is pivotally mounted on a bar 25 at a cylindrical end portion 26 and is held in place by a snap ring 27. Shafts 29 with thumb wheels 30 are threadedly inserted through the bar 25, with the lower ends of the shaft bearing against cross members 31 of the body, affixed to the cover 14 by screws 32.

In operation, the thumb wheels 30 are rotated to move the bar 25 near the top of the body. The tap shoe is then positioned on the terminal block, as shown in FIG. 1, with the contacts of the shoe in engagement with the contacts of the block. During this insertion, pins 33 carried at the lower ends of the arms 24 are guided through the open end portion of J shaped grooves 35 of the terminal block 11. Clearance passages 36 are provided in the terminal block 11 for the arms 24. Typically this may be provided by means of a recess in the main portion of the terminal block and application of a cover plate 38 over the recess, with the J groove 35 in the cover plate 38.

After the tap shoe is in position on the terminal block, the thumb wheels 30 are actuated to bring the pins 33 to the bottom of the J groove and the arms 24 are pivoted to move the pins into the short arms of the J grooves. The thumb wheels are then rotated to move the bar 25 away from the body of the tap shoe, bringing the pins into the closed short ends of the J groove and locking the tap shoe in position on the terminal block.

I claim:

1. In a tap shoe for connecting an electrical cable to an electrical terminal block, the combination of:

a body having a top, a bottom, opposing sides and opposing ends, with means defining a slot at each of said ends along a path between said top and bottom;

a plurality of electrical terminals carried in said body and accessible at said bottom;

a bar disposed along said top and having a longitudinal axis parallel to said top and bottom;

means for moving said bar away from said top;

a pivotally mounted arm carried at each end of said body on said bar, with each of said arms positioned in one of said slots and with each of said arms pivoting about said longitudinal axis in a plane parallel to said ends; and latching means carried adjacent the bottom end of each of said arms for engaging a cooperating latching means of a terminal block.

2. A tap shoe as defined in claim 1 wherein said arm latching means includes a laterally projecting pin for engaging a J shaped slot of said cooperating latching means.

3. A tap shoe as defined in claim 2 wherein said means for moving includes a rotating shaft threadedly engaging said bar intermediate the ends of the shaft, with one of said shaft ends bearing against said body top.

* * * * *